United States Patent [19]

Bragg et al.

[11] Patent Number: 4,817,863

[45] Date of Patent: Apr. 4, 1989

[54] VORTEX VALVE FLOW CONTROLLER IN VAV SYSTEMS

[75] Inventors: Gordon M. Bragg, Waterloo; Richard G. Carothers, Puslinch; Kenneth A. MacLeod, Newmarket, all of Canada; Marvin D. Nelson, Hennepin, Minn.

[73] Assignee: Honeywell Limited-Honeywell Limitée, North York, Canada

[21] Appl. No.: 94,980

[22] Filed: Sep. 10, 1987

[51] Int. Cl.[4] ..... F24F 13/08

[52] U.S. Cl. ..... 236/49.4; 137/805; 137/810; 137/813; 137/828; 236/80 D

[58] Field of Search ..... 137/805, 810, 811, 813, 137/828; 236/49 C, 80 D

[56] References Cited

U.S. PATENT DOCUMENTS

| | | | |
|---|---|---|---|
| 3,238,960 | 10/1963 | Hatch, Jr. | 137/81.5 |
| 3,267,946 | 4/1963 | Adams et al. | 137/81.5 |
| 3,336,931 | 8/1967 | Fox et al. | 137/813 |
| 3,343,790 | 8/1965 | Bowles | 235/200 |
| 3,435,822 | 6/1965 | Ziermann et al. | 128/145.6 |
| 3,467,121 | 10/1965 | Bowles | 137/81.5 |
| 3,478,960 | 11/1969 | Taylor | 137/805 X |
| 3,486,521 | 12/1969 | Mayer | 137/813 |
| 3,507,296 | 4/1970 | Fix et al. | 137/810 |
| 3,511,257 | 9/1968 | Chow | 137/81.5 |
| 3,513,865 | 12/1966 | Van Der Heyden | 137/81.5 |
| 3,521,657 | 12/1967 | Ayers | 137/81.5 |
| 3,587,605 | 10/1968 | Verplank | 137/81.5 |
| 3,638,672 | 2/1972 | Smith et al. | 137/813 |
| 3,923,244 | 12/1975 | Oshiroff | 137/805 X |
| 4,003,405 | 1/1977 | Hayes et al. | 138/40 |
| 4,148,333 | 4/1979 | Nawa et al. | 137/834 |
| 4,181,153 | 1/1980 | Osheroff | 137/838 |
| 4,205,597 | 6/1980 | Nawa et al. | 98/94 AC |
| 4,323,991 | 4/1982 | Holmes et al. | 137/813 X |
| 4,422,476 | 12/1983 | Blanchard | 137/810 |

*Primary Examiner*—William E. Tapolcai
*Attorney, Agent, or Firm*—Donald J. Lenkszus

[57] ABSTRACT

In variable air volume systems of buildings, a vortex valve is used for varying the volume of the air moving through the system.

15 Claims, 4 Drawing Sheets

VORTEX VALVE FLOW CONTROLLER IN VAV SYSTEMS

BACKGROUND OF THE INVENTION

The present invention relates to controlling flow in VAV systems and, more particularly, to the use of vortex valves for controlling the flow of air in variable air volume systems.

Temperature control systems in non-residential buildings typically rely upon variable air volume systems for delivering temperature controlled air to the zones or spaces within the building. Such variable air volume systems usually include an outdoor air duct for bringing outdoor air into the building, a return air duct for returning air from the spaces or zones being supplied from the variable air volume system a portion of which is to be mixed with outdoor air under control of a return air damper and the remaining return air being exhausted from the building under control of an exhaust air damper. In this typical VAV system, the mixture of return air and outdoor air is then treated through various heating coils, cooling coils, humidifiers and/or the like. A fan drives this treated air under control of a discharge air damper to a zone or zones.

The various dampers of the system are positioned by motors controlled from various controllers. The controller for the outdoor air damper, the return air damper and the exhaust air damper relies upon various inputs such as the temperature and/or humidity conditions of the return air, the temperature and/or humidity conditions of the outdoor air, and selects, based upon these inputs, an amount of outdoor air requiring the least expenditure of energy in order to treat the mixture of outdoor air and return air in order to meet the desired conditions of the zone being controlled by the variable air volume system. The discharge air damper is driven by a motor under control of a controller which can respond to temperature and/or flow sensors for maintaining the proper flow conditions for the discharge air being discharged by the fan or may operate off of a temperature sensor located within the space for delivering the right amount of temperature controlled air to satisfy the thermostat within the zone.

If the fan system supplies a plurality of zones, then a plurality of air dampers are used each regulating the supply of air to its respective zone under control of a zone thermostat for supplying the right amount of air to the respective zone for satisfying its temperature needs.

Dampers used in these types of systems or in other types of air handling systems such as fume hoods, static pressure controls for spaces or zones, and the like can require complex mechanical linkages between the dampers and the motors and are expensive to construct, install and maintain. The present invention replaces these dampers with vortex valves. Such valves have a minimum number of moving parts and are relatively simple to construct. The present invention also permits the control fluid flow path to be integrally embedded in the vortex valve enclosure at the time of manufacture for ease of construction.

SUMMARY OF THE INVENTION

Accordingly, the present invention relates to an air flow control system in which a vortex valve has an inlet for receiving supply air from an air inlet duct, an outlet for discharging controlled discharge air to an air outlet duct, and a control port for receiving a control signal, the vortex valve controlling the flow of air from its inlet to its outlet in response to the control signal. The system further includes a sensor mechanism for sensing a condition of air and for supplying the control signal to the control port of the vortex valve wherein flow of the discharge air is controlled in response to the condition sensed by the sensor mechanism.

BRIEF DESCRIPTION OF THE DRAWINGS

These and other features and advantages will become more apparent from a detailed consideration of the invention when taken in conjunction with the drawings in which.

DETAILED DESCRIPTION

Figure 1:
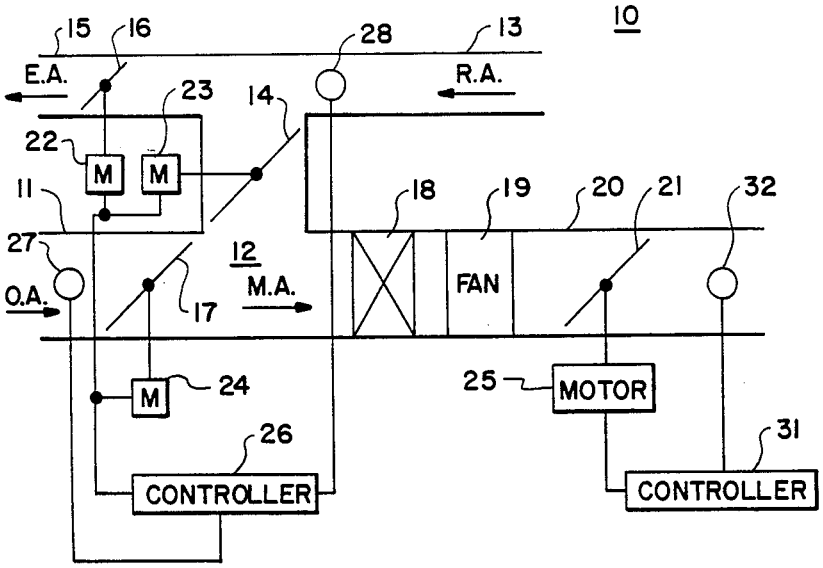
Fig. 1 PRIOR ART
FIG. 1 shows a typical variable air volume system.

FIG. 1 shows a typical variable air volume system in which outdoor air damper 17 controls the flow of outdoor air through outdoor air duct 11 to mixing chamber 12 wherein outdoor air is mixed with return air flowing through return air duct 13. A portion of the return air flowing through return air duct 13 is supplied to mixing chamber 12 through return air damper 14 and the remaining return air is exhausted from the building in which the variable air volume system is located through exhaust air duct 15 under control of exhaust air damper 16.

The mixed air is supplied through coil 18 which may be a cooling coil supplied with cooled water from a chiller or may be a heating coil supplied with hot water from a boiler in order to cool or heat the mixed air as is appropriate. Also, there may be sprayers or other humidifying apparatus (not shown) for humidifying the air supplied to the space to which the variable air volume system of FIG. 1 is connected. Air is moved through the air volume system 10 by fan 19. Fan 19 supplies discharge air through discharge air duct 20 under control of discharge air damper 21 to the zone or zones of the building connected to fan system 10.

Exhaust air damper 16 is driven by motor 22, return air damper 14 is driven by motor 23, outdoor air damper 17 is driven by motor 24 and discharge air damper 21 is driven by motor 25. Motors 22, 23 and 24 are controlled by controller 26 which receives signals from an outdoor air sensor 27 and a return air sensor 28, which may be temperature sensors, humidity sensors, enthalpy sensors or the like. Motor 25 is operated under control of controller 31 which receives an input from sensor 32 which may be a temperature sensor, flow sensor or the like.

In a system such as variable air volume system 10 shown in FIG. 1, controller 26 can be arranged for controlling dampers 14, 16 and 17 so that the mixed air in mixing chamber 12 requires the least energy input to coil 18 to treat the air in order to meet the required conditions of the zone to which the variable air volume system 10 is connected. Accordingly, controller 26 may sample temperature and humidity conditions of both the outdoor air and the return air and mixes these two airs in such a way as to require a minimum amount of treatment in order to satisfy the desired conditions of the zones, taking into account code requirements for the minimum amount of outdoor air which must, under all circumstances, be taken into the building.

Controller 31 controls damper 21 in a fashion to maintain a predetermined amount of flow of the discharge air moving through discharge air duct 20 or may control damper 21 in such a way as to satisfy the temperature requirements of the zones to which variable air volume system 10 is connected.

Figure 2:
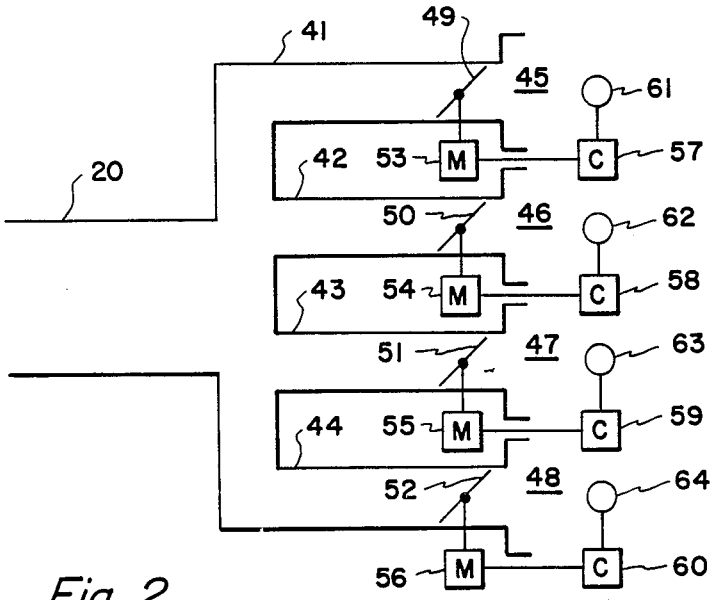
Fig. 2 PRIOR ART
FIG. 2 shows a variable air volume system for supplying plural zones.

FIG. 2 shows that discharge air duct 20 may instead or in combination be connected to a plurality of ducts 41, 42, 43 and 44 for supplying a plurality of zones 45, 46, 47 and 48 respectively. Since the control apparatus for each zone is identical, only the control apparatus associated with duct 41 and zone 45 will be described.

Damper 49 is located within duct 41 for controlling the amount of air being discharged to zone 45. Damper 49 is driven by motor 53 under control of controller 57 which is responsive to a temperature sensor 61. Temperature sensor 61 senses the temperature of zone 45 and appropriately operates through controller 47 to energize motor 53 to drive damper 49 to a position which will allow duct 41 to supply a flow of air to zone 45 in order to satisfy thermostat 61 at the desired or setpoint temperature.

Typical dampers which can be used for the dampers shown in FIGS. 1 and 2 require complex mechanical linkages between the damper and the motor so that the motors can drive the dampers to their correct positions. These linkages may be different for different applications or for different control conditions. For example, if damper 16 is normally open, then damper 14 should be normally closed so that if all return air is exhausted, no return air is supplied to mixing chamber 12. Moreover, if return air damper 14 is normally closed, outdoor air damper 17 is normally open but, when it is closed, damper 17 must still permit a minimum intake of fresh air to meet code requirements. As can be seen, linkages to accommodate these control actions can be quite complex.

The complexity of these mechanical arrangements increases the service requirements of dampers and decreases the life expectancy of these flow controlling devices. Vortex valves can be used to control air moving through ducts without the complex mechanical linkages of prior art damper devices and also have the benefit that the motors necessary to drive dampers are no longer necessary.

Figure 3:
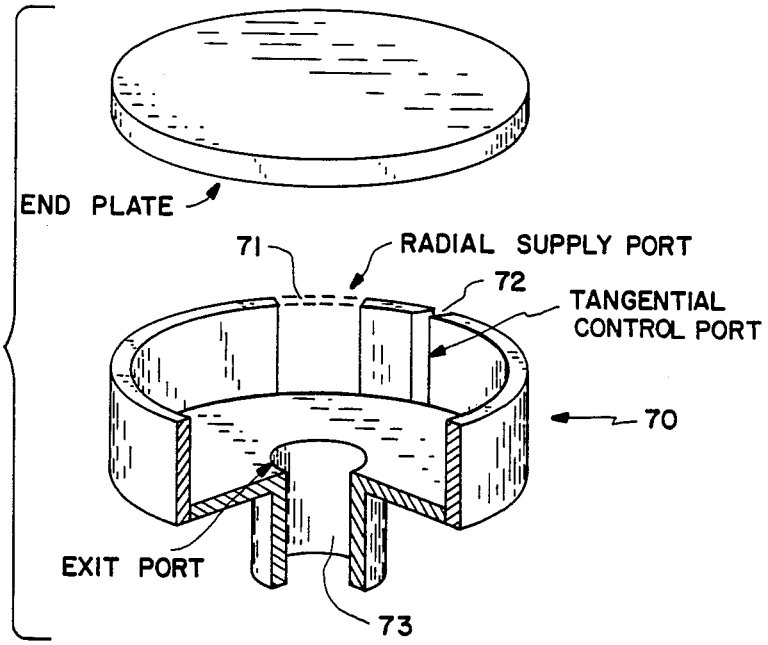
FIG. 3 shows in schematic form a vortex valve.

FIG. 3 shows a vortex valve 70 having a radial inlet supply port 71, control port 72 and an exit or discharge port 73. Fluid is supplied to vortex valve 70 through supply port 71 typically in a radial direction to the exit or discharge port 73. A vortex of this supply fluid is established by the flow of control fluid connected to vortex valve 70 through control port 72. Accordingly, a vortex of varying strength is created within the valve chamber of vortex valve 70 by the tangential control flow from control port 72. The centrifugal forces produced thereby alter the resistance encountered by the inward radial supply flow from supply port 71. This resistance is the static pressure drop from supply port 71 to exit or discharge port 73. Accordingly, this resistance under control of the flow from control port 72 can be increased to the point where flow from control point 71 to exhaust or discharge port 73 is cut off. At this cut off point, only the control flow from control port 72 exits from the vortex valve. This control flow leakage can either be recirculated or, upon proper geometric design of the valve, can be substantially eliminated.

Figure 4:
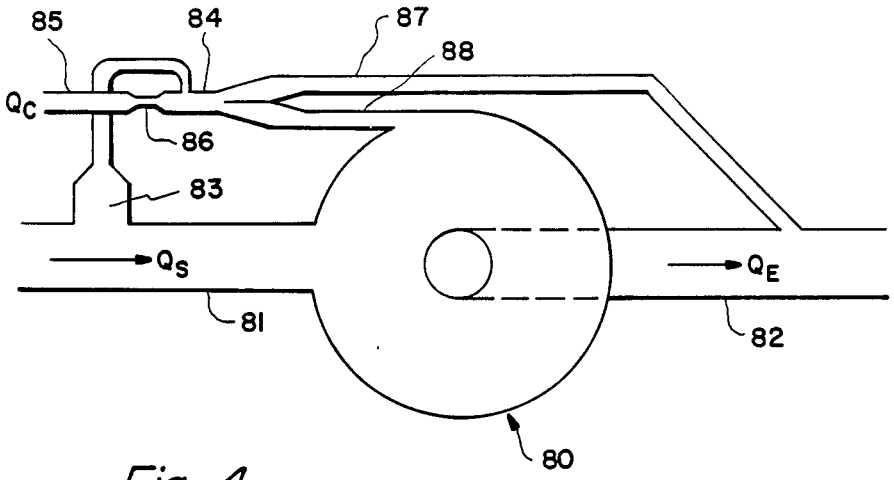
FIG. 4 shows one arrangement for a vortex valve which can be used in a variable air volume system.

FIG. 4 shows a vortex valve arrangement which receives a control flow $Q_C$ from a condition controller and is also arranged to compensate for variations in supply pressure. In this arrangement, vortex valve 80 has its supply port connected to supply duct 81 and its exhaust or discharge port connected to exhaust or discharge duct 82. Pressure tap 83 is arranged to connect the pressure within supply duct 81 to control tube 84 which receives control flow $Q_C$ from inlet tube 85 through restriction 86. This control flow $Q_C$ is then supplied to receiving tubes 87 and 88. Without the connection from tap 83, this control fluid would be divided equally between receiving tube 87 and receiving tube 88. The flow received by receiving tube 87 is discharged into discharge duct 82 whereas the flow in receiving tube 88 is connected to the control port of vortex valve 80. Accordingly, the flow in receiving tube 88 is used to control the amount of air discharged into discharge air duct 82 from supply duct 81.

The pressure in pressure tap 83, however, will bias the control flow $Q_C$ towards one or the other of the receiving tubes 87 and 88 depending upon the amount of pressure sensed by pressure tap 83. Accordingly, changes in pressure within supply duct 81 can be compensated by the system so that the discharge flow through discharge duct 82 is substantially unaffected by changes in supply pressure.

Figure 5:
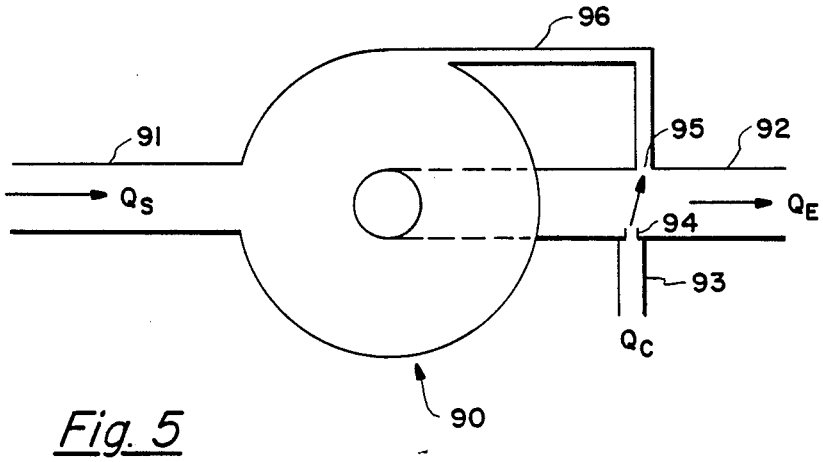
FIG. 5 shows another arrangement for a vortex valve which can be used in a variable air volume system.

The arrangement of FIG. 5 shows that this compensation function can be provided downstream of the vortex valve rather than upstream. According to FIG. 5, vortex valve 90 has its supply port connected to supply duct 91 for receiving the supply flow $Q_S$ and its exhaust or discharge port connected to exhaust or discharge duct 92 for receiving discharge flow $Q_E$. Tube 93 is connected to one side of discharge duct 92 and has a nozzle 94 for emitting a of air towards receiving nozzle 95 situated across the duct 92 from nozzle 94. This nozzle 95 is then connected to a tube or duct 96 which is in turn connected to the control port of vortex valve 90. Tube or duct 93 receives the control flow $Q_C$. The strength of this control flow $Q_C$ will determine how much of the control flow is picked up by receiving nozzle 95 and, therefore, determines the amount of control flow supplied to the control port of vortex valve 90. Any changes in the discharge flow $Q_E$ will change the amount by which this jet of air from nozzle 94 to nozzle 95 is deflected resulting in changes in the flow of control fluid through duct or tube 96. Accordingly, changes in discharge flow $Q_E$ brought about by changes in supply flow $Q_S$ are compensated.

The control flows $Q_C$ shown in FIGS. 4 and 5 can be supplied from a control means which supplies the control flow in response to a condition being sensed. This condition can be temperature, humidity, flow or other physical parameter of air within a variable air volume system.

Figure 6:
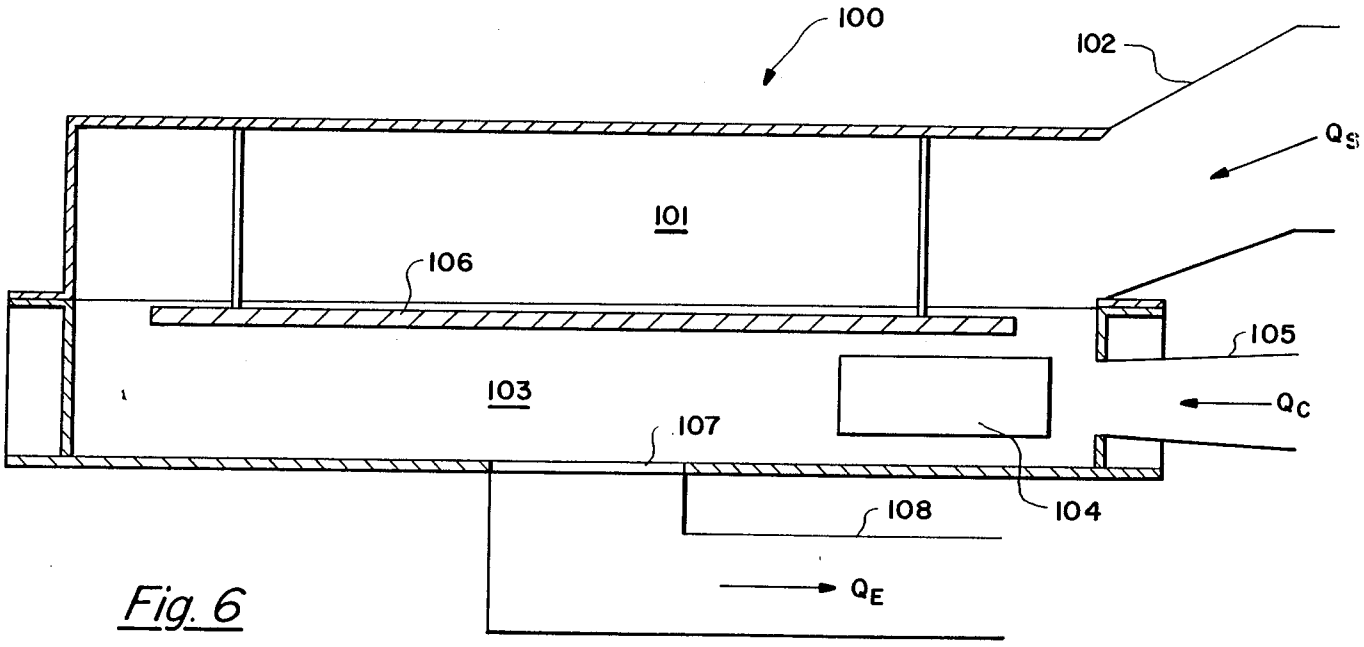
FIG. 6 shows a vortex valve as it might be connected to a supply flow duct, a control flow duct and a discharge duct; and, FIG. 7 shows a schematic diagram of a variable air volume system incorporating a vortex valve.

FIG. 6 shows a vortex valve connected to the supply, discharge and control ducts of a variable air volume system in more detail. Vortex valve 100 comprises supply chamber 101 connected to duct 102 for receiving supply flow $Q_S$. Control chamber 103 receives control $Q_C$ through control port 104 and is separated from supply chamber 101 by separator plate 106 which, as can be seen in FIG. 6, has an area smaller than the cross sectional area of vortex valve 100 so that supply chamber 101 has access to control chamber 103. Control flow $Q_C$ then controls the amount of supply flow $Q_S$ which is received at exit port 107 and flows as discharge flow $Q_E$ through discharge duct 108.

Figure 7:
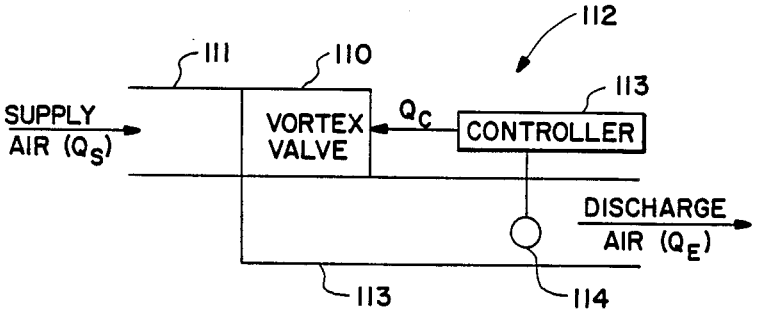

FIG. 7 shows the vortex valve 110 which receives supply air $Q_S$ from supply duct 111 and control flow $Q_C$ from control means 112. The amount of supply flow $Q_S$ being connected to discharge air duct 113 connected to the exit port of vortex valve 110 depends upon the amount of control flow $Q_C$. Control means 112 can include a controller 113 for supplying the control flow $Q_C$ under control of sensor 114 which may be located in the discharge duct 113 but can also be located in the spaces supplied with the air from discharge duct 113 or in supply duct 111.

The embodiments of the invention in which an exclusive property or right is claimed are defined as follows:

1. An air flow control system comprising:

vortex valve means having an inlet for receiving supply air from a supply air duct, an outlet for discharging air to a discharge air duct, and a control port for receiving a vortex control signal, said vortex valve means controlling the flow of said discharge air by controlling the flow of air from said inlet to said outlet in response to said vortex control signal; and, control means including means responsive to a physical condition of air for supplying said vortex control signal to said control port of said vortex valve means for causing said vortex valve means to control the flow of said discharge air in response to said physical condition and said control means further including compensation means for controlling said control means to cause said vortex valve means to maintain said flow of said discharge air substantially unaffected by changes in flow of supply air.

2. The system of claim 1 wherein said control means comprises pneumatic control signal means for supplying a neumatic control signal in response to said physical condition and wherein said compensation means controls said pneumatic control signal in response to said flow of said supply air for producing said vortex control signal, said compensation means controlling said pneumatic control signal to compensate for changes in said flow of said supply air.

3. The system of claim 2 wherein said control means comprises first and second receiving means and wherein said compensation means is connected to said pneumatic control signal means for influencing the amount of pneumatic control signal received by each of said first and second receiving means in response to flow of said supply air, said first receiving means connected to said discharge air duct and said second receiving means connected to said control port of said vortex valve means.

4. The system of claim 1 wherein said control means comprises compensation means for sensing changes in flow of said discharge air caused by changes in flow of said supply air and for controlling said vortex valve means so that said flow of discharge air remains substantially uninfluenced by changes flow of supply air.

5. The system of claim 4 wherein said compensation means comprises first means for receiving a pneumatic control signal in response to said physical condition and for issuing a jet of air substantially transverse to the flow of discharge air through said discharge air duct and a receiving tube for receiving said jet of air and for supplying said vortex control signal to said control port of said vortex valve means.

6. In a fan or ejector system having a fan or ejector for moving air from one location of an enclosure to another location through at least one duct, an air flow control arrangement comprising:

vortex valve means positioned in said duct for controlling air moving through said duct, said vortex valve means having an inlet for receiving supply air moving through said duct upstream of said vortex valve means, an outlet for discharging discharge air to said duct downstream of said vortex valve means, and a control port for receiving a vortex control signal, said vortex valve means controlling the flow of said discharge air by controlling the flow of air from said inlet to said outlet in response to said vortex control signal; and, control means including means responsive to a physical condition of air for supplying said vortex control signal to said control port of said vortex valve means for causing said vortex valve means to control the flow of said discharge air in response to said physical condition and said control means further including compensation means for causing said vortex valve means to maintain said flow of said discharge air substantially unaffected by changes in flow of supply air.

7. The system of claim 6 wherein said control means comprises pneumatic control signal means for supplying a pneumatic control signal in response to said physical condition and wherein said compensation means controls said pneumatic control signal in response to said flow of said supply air for producing said vortex control signal, said compensation means controlling said pneumatic control signal to compensate for changes in said flow of said supply air.

8. The system of claim 7 wherein said control means comprises first and second receiving means and wherein said compensation means is connected to said pneumatic control signal means for influencing the amount of pneumatic control signal received by each of said first and second receiving means in response to flow of said supply air, said first receiving means connected to said discharge air duct and said second receiving means connected to said control port of said vortex valve means.

9. The system of claim 6 wherein said control means comprises compensation means for sensing changes in flow of said discharge air caused by changes in flow of said supply air and for controlling said valve means so that said flow of discharge air remains substantially uninfluenced by changes flow of supply air.

10. The system of claim 9 wherein said compensation means comprises first means for receiving a pneumatic control signal in response to said physical condition and for issuing a jet of air substantially transverse to the flow of discharge air through said discharge air duct and a receiving tube for receiving said jet of air and for supplying said vortex control signal to said control port of said vortex valve means.

11. In a fan or ejector system having a fan or ejector for moving air from one location of an enclosure to another location through at least one duct, a temperature control system for controlling the temperature of air in a space comprising:

vortex valve means for controlling air moving through said duct, said vortex valve means having an inlet for receiving supply air moving through said duct upstream of said vortex valve means, an outlet for discharging discharge air to said duct downstream of said vortex valve means, said discharge air being supplied to a space, and a control port for receiving a vortex control signal, said vortex valve means controlling the flow of said discharge air by controlling the flow of air from said inlet to said outlet in response to said vortex control signal; and, control means including means responsive to said temperature for supplying said vortex control signal to said control port of said vortex valve means for causing said vortex valve means to control the flow of said discharge air in response to said temperature and said control means further including compensation means for causing said vortex valve means to maintain said flow of said discharge air substantially unaffected by changes in flow of supply air.

12. The system of claim 11 wherein said control means comprises pneumatic control signal in response to said temperature and wherein said compensation means controls said pneumatic control signal in response to said flow of said supply air for providing said vortex control signal whereby said flow of said discharge air is substantially uninfluenced by changes in said flow of said supply air.

13. The system of claim 12 wherein said control means comprises first and second receiving means and wherein said compensation means is connected to said pneumatic control signal means for influencing the amount of pneumatic control signal received by each of said first and second receiving means in response to flow of said supply air, said first receiving means connected to said discharge air duct and said second receiving means connected to said control port of said vortex valve means.

14. The system of claim 11 wherein said control means comprises compensation means for sensing changes in flow of said discharge air caused by changes in flow of said supply air and for controlling said vortex valve means so that said flow of discharge air remains substantially uninfluenced by changes flow of supply air.

15. The system of claim 14 wherein said compensation means comprises first means for receiving a pneumatic control signal in response to said temperature and for issuing a jet of air substantially transverse to the flow of discharge air through said discharge air duct and a receiving tube for receiving said jet of air and for supplying said vortex valve control signal to said control port of said vortex valve means.

* * * * *